US008033900B2

(12) United States Patent
Vanden Bosch et al.

(10) Patent No.: US 8,033,900 B2
(45) Date of Patent: Oct. 11, 2011

(54) LOW PROFILE ANIMAL RESTRICTING VENT FOR FLUID DISCHARGE CONDUITS

(75) Inventors: Kalvin K. Vanden Bosch, West Olive, MI (US); Brian R. Dykstra, Zeeland, MI (US)

(73) Assignee: P-tec Products, Inc., Zeeland, MI (US)

( * ) Notice: Subject to any disclaimer, the term of this patent is extended or adjusted under 35 U.S.C. 154(b) by 630 days.

(21) Appl. No.: 12/201,616

(22) Filed: Aug. 29, 2008

(65) Prior Publication Data

US 2009/0081942 A1 Mar. 26, 2009

Related U.S. Application Data

(60) Provisional application No. 60/974,129, filed on Sep. 21, 2007.

(51) Int. Cl.
*F24F 7/00* (2006.01)
*F24F 13/08* (2006.01)

(52) U.S. Cl. ..... 454/359; 454/339; 454/358; 454/361; 454/270; 454/271; 454/275; 454/276; 454/277; 454/278

(58) Field of Classification Search ..... 454/359, 454/275, 276, 347, 358, 339, 271, 162, 369, 454/361, 367, 368, 363, 5, 298; 137/512.2
See application file for complete search history.

(56) References Cited

U.S. PATENT DOCUMENTS

| | | | | |
|---|---|---|---|---|
| 2,770,833 | A | | 11/1956 | Drechsel |
| 3,171,343 | A | | 3/1965 | Wexler |
| 3,842,722 | A | | 10/1974 | Miller |
| 4,151,789 | A | | 5/1979 | Grobard |
| 4,334,461 | A | | 6/1982 | Ferguson et al. |
| 5,046,408 | A | | 9/1991 | Eugenio |
| 5,722,181 | A | | 3/1998 | Meyer |
| 5,762,551 | A | * | 6/1998 | Lachapelle et al. ..... 454/359 |
| 5,765,319 | A | * | 6/1998 | Callaghan, Jr. ..... 52/101 |
| 5,916,023 | A | | 6/1999 | Meyer |
| 6,165,065 | A | * | 12/2000 | Pasij ..... 454/212 |
| 6,302,788 | B1 | | 10/2001 | Gagnon |
| 6,361,433 | B1 | | 3/2002 | Gray |

(Continued)

OTHER PUBLICATIONS

Non-Final Office Action dated Mar. 18, 2010 in copending U.S. Appl. No. 11/477,845 (U.S. Pub. No. 2007/0010191), filed Jun. 29, 2006.

(Continued)

*Primary Examiner* — Steven B McAllister
*Assistant Examiner* — Brittany E Towns
(74) *Attorney, Agent, or Firm* — Gardner, Linn, Burkhart & Flory, LLP

(57) ABSTRACT

A vent assembly for attachment to a fluid discharge conduit of the type connected to a clothes dryer, room exhaust fan, or the like is adapted to reduce or prevent the trapping of dirt or lint as well as flapping or vibration of the door in windy conditions. A mount having an opening is received on the conduit and a door is pivotally received by the mount. The door is operable for displacement with respect to the opening between an open position and a closed position when engaged by a fluid, such as air from a clothes dryer, flowing through the discharge conduit. A hood is pivotally mounted over the door and mount opening, and is operable for displacement with respect to the mount when engaged by the door and/or by fluid flowing through the discharge conduit.

25 Claims, 11 Drawing Sheets

U.S. PATENT DOCUMENTS

| | | | | |
|---|---|---|---|---|
| 6,468,147 | B1 * | 10/2002 | Thomas | 454/136 |
| 6,682,415 | B1 | 1/2004 | Vagedes | |
| 2007/0010191 | A1 | 1/2007 | Vanden Bosch et al. | |

OTHER PUBLICATIONS

Applicants' Response dated Jun. 16, 2010 in copending U.S. Appl. No. 11/477,845 (U.S. Pub. No. 2007/0010191), filed Jun. 29, 2006.

Final Office Action dated Aug. 18, 2010 in copending U.S. Appl. No. 11/477,845 (U.S. Pub. No. 2007/0010191), filed Jun. 29, 2006.

Applicants' Response dated Oct. 19, 2010 in copending U.S. Appl. No. 11/477,845 (U.S. Pub. No. 2007/0010191), filed Jun. 29, 2006.

Non-Final Office Action dated Oct. 25, 2010 in copending U.S. Appl. No. 11/477,845 (U.S. Pub. No. 2007/0010191), filed Jun. 29, 2006.

Applicants' Response dated Jan. 25, 2011 in copending U.S. Appl. No. 11/477,845 (U.S. Pub. No. 2007/0010191), filed Jun. 29, 2006.

* cited by examiner

LOW PROFILE ANIMAL RESTRICTING VENT FOR FLUID DISCHARGE CONDUITS

CROSS REFERENCE TO RELATED APPLICATION

The present invention claims the benefit of U.S. provisional application Ser. No. 60/974,129, filed Sep. 21, 2007, which is hereby incorporated herein by reference in its entirety.

FIELD OF THE INVENTION

The present invention relates in general to venting and conduit devices for routing fluid/air exhaust, such as from a clothes dryer or the like, from within a structure to a remote location outside of the structure.

BACKGROUND OF THE INVENTION

The exhaust from a clothes dryer, a bathroom fan, a kitchen fan or similar device is typically routed to the outside atmosphere by means of some type of conduit and vent. The exit location from the corresponding structure is typically an outside wall of the structure. The conduit is secured to an exhaust conduit of the clothes dryer, bathroom fan, or kitchen fan and then routed to the exit location. At the exit location a flow opening or passageway is created in the structure wall and a suitable vent is mounted into, onto, or across the exit flow opening. In order to substantially prevent the inflow or backflow of outside air, as well as to prevent the entry of moisture which may result from rain or snow, conventional exhaust vents may be covered with a hood and may include a one-way or hinged flapper or a series of hinged louvers secured within a surrounding frame.

One of the problems with conventional vents, such as louvers or flappers, is that external vent hoods and even the conduit itself open out into the atmosphere and create a protected, warm location for birds and small animals to nest. The building of a nest in this area can prevent the conduit, flappers or louvers from freely opening in response to exiting exhaust air from the clothes dryer or similar device. Such an obstruction caused by the nest and/or birds or animals may interfere with the operation of the clothes dryer, cause damage to the clothes dryer, and could even create a risk of fire. Additionally, conventional clothes dryers may not provide any heat when such an obstruction causes limited or diminished air flow to the dryer. Even if the flapper or louvers are operable, an open and unguarded conduit provides an entrance path into the structure for birds and small animals. Moreover, birds and small animals are often able to open the flappers or louvers to gain entry into the conduit.

Some conventional systems utilize grid-like guards to cover either the conduit opening or hood opening to prevent entry of birds and small animals. However, these conventional grid-like guard systems require constant monitoring to prevent build up of lint exiting the clothes dryer through the conduit, and require frequent and repeated cleanings to clear the passageways. If the screen or grid is not cleaned or cleared, the blockage of air flow may interfere with the operation of the clothes dryer or other device. Additionally, conventional systems also experience issues with chattering or vibration from vents during operation. Further, conventional systems equipped with relatively large, fixed hoods are generally unsightly, may entrap lint or other debris within the hood due to turbulence in the air or fluid flow within the hood, and may provide attractive space for hornet and wasp nests and the like. Also, fixed hood vents having pivoting vent doors may also encounter annoying and noisy flapping of the door within the hood in windy conditions even when there is no air flow through the conduit. This flapping can also create the opportunity for nesting and/or entry of birds or animals in the fluid conduit.

Therefore, there is a need for an improvement to existing dryer exhaust vent design so that birds and small animals or insects cannot nest inside the hood or gain access to the area adjacent to the vent flapper or vent louvers around the conduit.

There is a further need for unrestricted, free flow of exhaust from the clothes dryer while still providing a suitable barrier to the entry of birds and small animals without requiring frequent repeated inspection and maintenance to ensure unrestricted free flow of exhaust.

SUMMARY OF THE INVENTION

The present invention provides a vent assembly for a discharge conduit which, when installed on the conduit, provides a venting system that mitigates the above-discussed difficulties. The vent assembly of the present invention provides a hinged door for covering the discharge conduit and a hinged low-profile hood for covering the door. The door preferably has a surface portion that requires the door to be sufficiently moved out of the discharge conduit before access to the conduit is obtained, whereby birds and other wildlife are restricted from entering the conduit. The vent assembly of the present invention eliminates the need for continuous and repeated monitoring of the discharge conduit and/or vent assembly itself for any buildup of materials and the like.

According to one form of the present invention, a vent assembly for attachment to a fluid discharge conduit includes a mount having an opening received on the conduit, a door pivotally received by the mount for covering the opening on the mount, and a hood pivotally received by the mount for covering the opening on the mount and the door. The door is movable between an open position and a closed position, with respect to the opening, when the door is engaged by fluid flowing through the discharge conduit. The hood is movable with respect to the mount and the door. The hood and the door restrict birds, animals, and the like from entering the conduit while permitting the flow of air or fluid out of the conduit.

According to one aspect, the first and second surface portions of the door form a wedge-like shape. The first surface portion includes a planar plate. The second surface portion includes a conical wall forming a base of the wedge-like shape. The base is located opposite the position at which the door is pivotally received by the mount.

According to another aspect, the first and second surface portions of the door form a recessed cavity in the door.

In yet another aspect of the present invention, the door further includes a lip extending from the edge of the door and engaging the opening in the closed position. The opening includes a rim surface protruding from the mount to receive the conduit. The rim surface receives and engages the door in the closed position. The lip rests substantially flush on the rim surface. The first and second surface portions extend into the opening when the door is in the closed position.

According to still another aspect of the present invention, the hood is urged into the open position only after the door pivots sufficiently to contact the hood. The door may support the hood in the hood's open position when the door is engaged by fluid flowing through the discharge conduit. Alternatively, the hood may be urged into the open position when the hood is engaged by fluid flowing through the discharge conduit.

In another form of the present invention, a venting system includes a discharge conduit connectable to an air exhaust outlet with an open end, a mount having an opening received by the discharge conduit, a door pivotally received by the mount, and a hood pivotally received by the mount. The door includes a first surface portion for covering at least a portion of the opening, and a second surface portion extending from the door and protruding into the opening. The door is operable for displacement with respect to the opening between an opened position and a closed position when the door is engaged by a fluid flowing through the discharge conduit. The hood is operable for displacement with respect to the mount and the door. The door is in the open position only after the door pivots sufficiently to move the first and second surface portions fully out of the opening, whereby birds, animals, and the like are restricted from entering the conduit.

According to another form of the present invention, a vent assembly for attachment to a fluid discharge conduit includes a mount, a door, and a hood. The mount has an opening for receiving the conduit. The door and hood are pivotally mounted or hinged to the mount via respective hinge members, with the hood covering the door when both are in a closed position. The hood includes a substantially continuous edge that contacts, abuts, or rests adjacent to the mount and surrounds the opening and door when the hood is closed. The door is positionable between an open position when fluid is discharged from the conduit, and a closed position when fluid is not discharged from the conduit. The hood is similarly positionable between open and closed positions according to the discharge of the fluid from the conduit and the position of the door. The door and/or hood are thus closed, and the hood substantially covers the door, when fluid is not being discharged from the conduit, whereby birds, animals, and the like are restricted from entering the conduit.

In one aspect, at least a portion of an upper region of the hood extends downwardly away from the hood's hinge member when the hood is in the closed position, thereby at least partially defining a fluid path between the upper region of the door and the mount when the hood is open.

In another aspect, the fluid path permits an ambient fluid to be drawn along the door in response to the discharge fluid flowing through the conduit.

Therefore, the present invention provides a vent assembly for attachment to a fluid discharge conduit. The vent assembly preferably includes a door with a first surface portion, a second surface portion, and a lip surface for effectively closing an open end of the discharge conduit and freely opening to allow exhaust fluid from the discharge conduit. The vent assembly further includes a hood for aesthetically covering the door in a low-profile configuration when the door is closed, and for permitting free flow of fluid past the door and hood when the door and hood are in respective open positions. The first and second surface portions of the door extend from the door and protrude into the open end of the discharge conduit. The first and second surface portions of the door must be moved completely out of open end of the discharge conduit to place the door in an open position, thereby restricting entry of a bird or small animal into the discharge conduit. The vent assembly also reduces the buildup of lint and other matter that may collect in passageways of the discharge conduit and interfere with operations of a dryer or other similar devices. The vent assembly freely discharges lint and other matter from a discharge conduit to reduce the need for continuous and repeated monitoring of the discharge conduit for any buildup of lint or the like. Further, the present invention substantially prevents movement of the door in windy conditions when there is no fluid flow through the conduit.

These and other objects, advantages, purposes, and features of the present invention will become apparent upon review of the specification in conjunction with the drawings.

DESCRIPTION OF THE PREFERRED EMBODIMENTS

Figure 1:
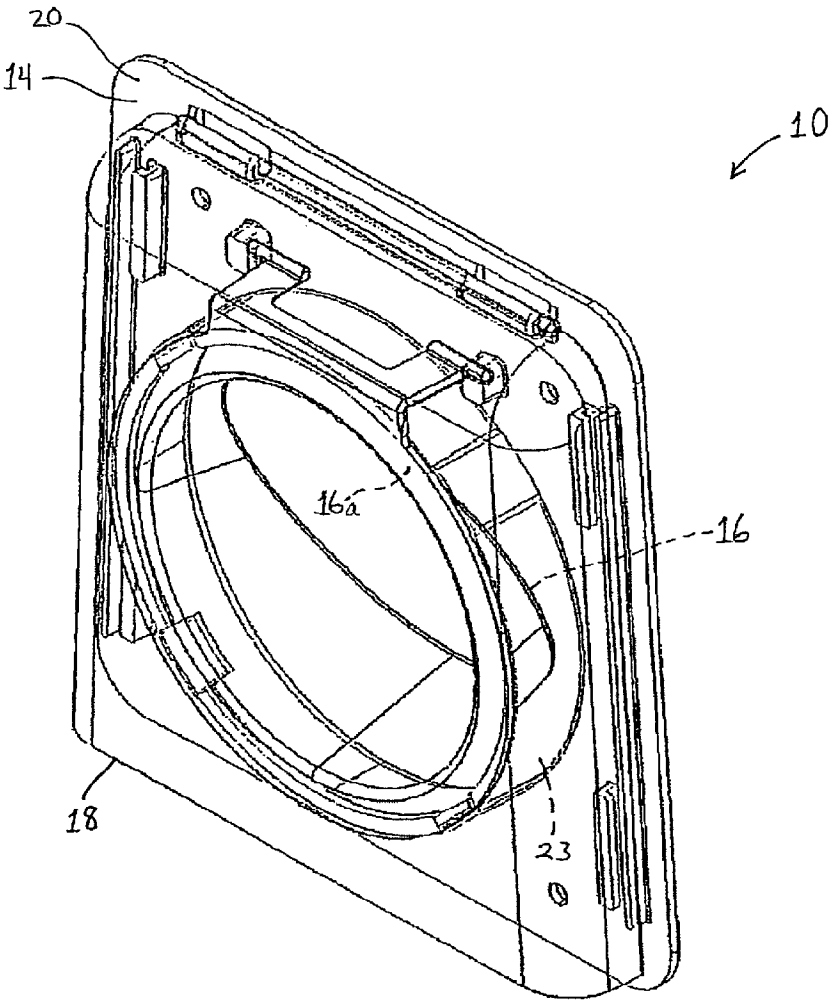
FIG. 1 is a perspective view of a vent assembly in accordance with the present invention with the hood shown in phantom.
Figure 4A:
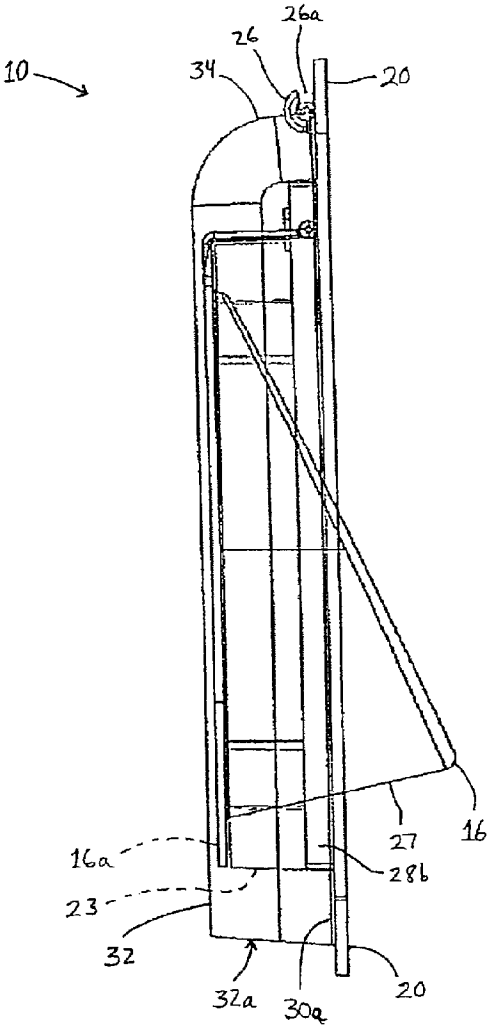
FIG. 4A is a side elevation of the vent assembly in a closed position.
Figure 4B:
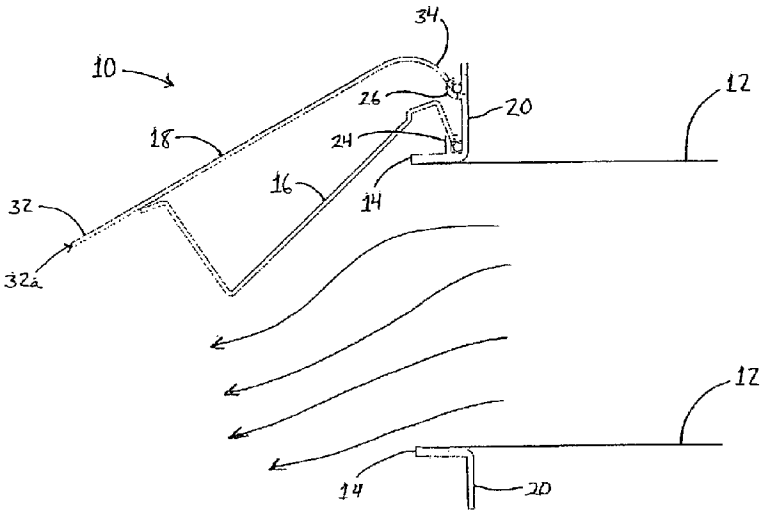
FIG. 4B is a side sectional view of the vent assembly in an open position when air is flowing through the conduit.
Figure 6:
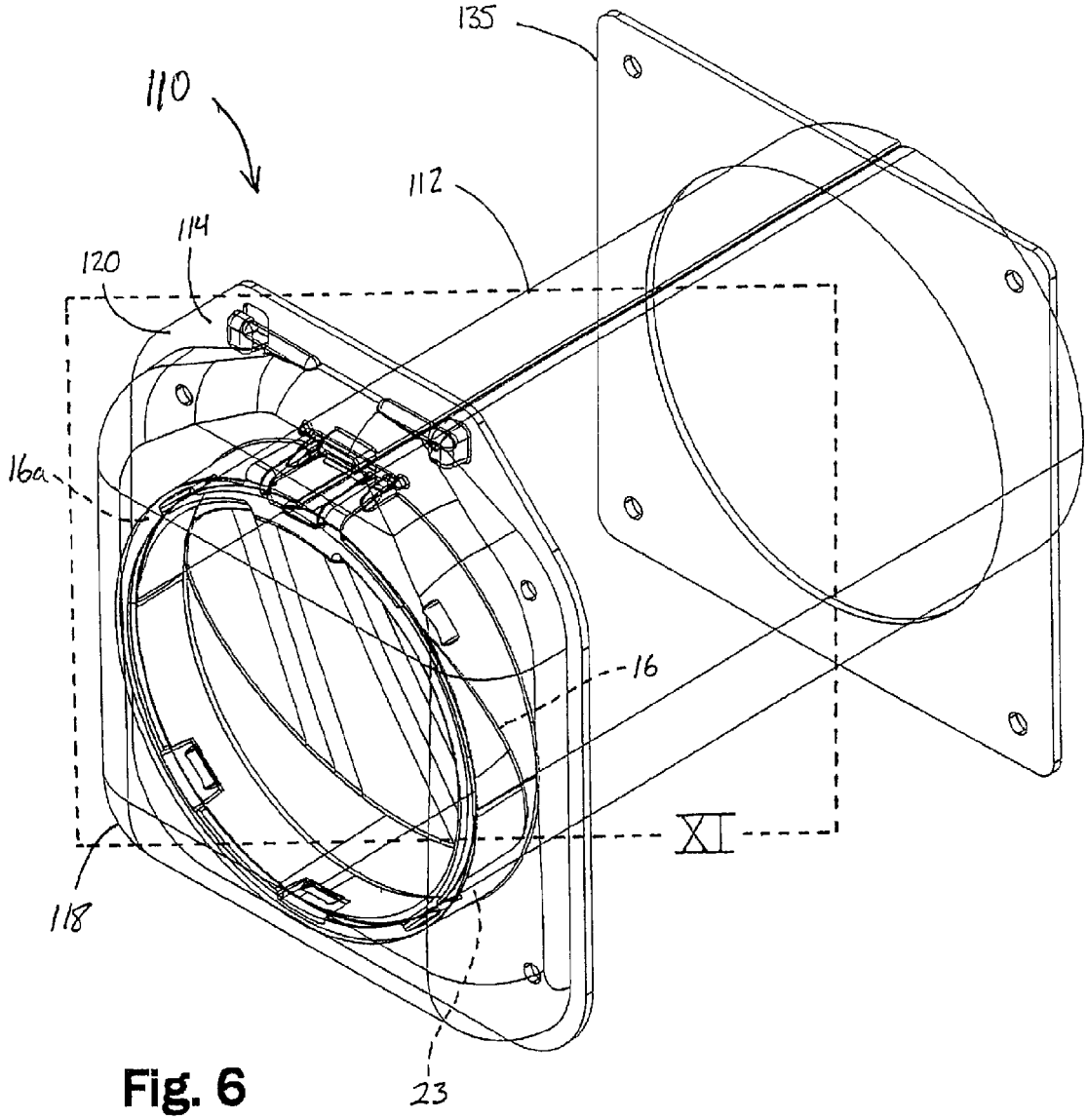
FIG. 6 is a perspective view of another embodiment of the vent assembly with the hood shown in phantom.

Referring now the drawings and the illustrative embodiments depicted therein, a bird and small animal restricting vent assembly 10 for use in attachment to a fluid/air discharge conduit 12 is provided for protecting conduit 12 and presenting an aesthetically pleasing appearance (FIGS. 1 and 4B). Vent assembly 10 includes a mounting member or mount 14, a door 16, and a hood 18, and is adapted to mount on and engage fluid discharge conduit 12. Discharge conduit 12 is typically connected to an exhaust outlet (not shown) from a clothes dryer, a bathroom fan, a kitchen fan, or similar device to discharge fluid/air into the atmosphere outside a building, house, or similar structure (not shown). The term "air" is used hereafter to refer generally to any fluid that is vented through a conduit, and is not intended to be limiting in any way.

Figure 2:
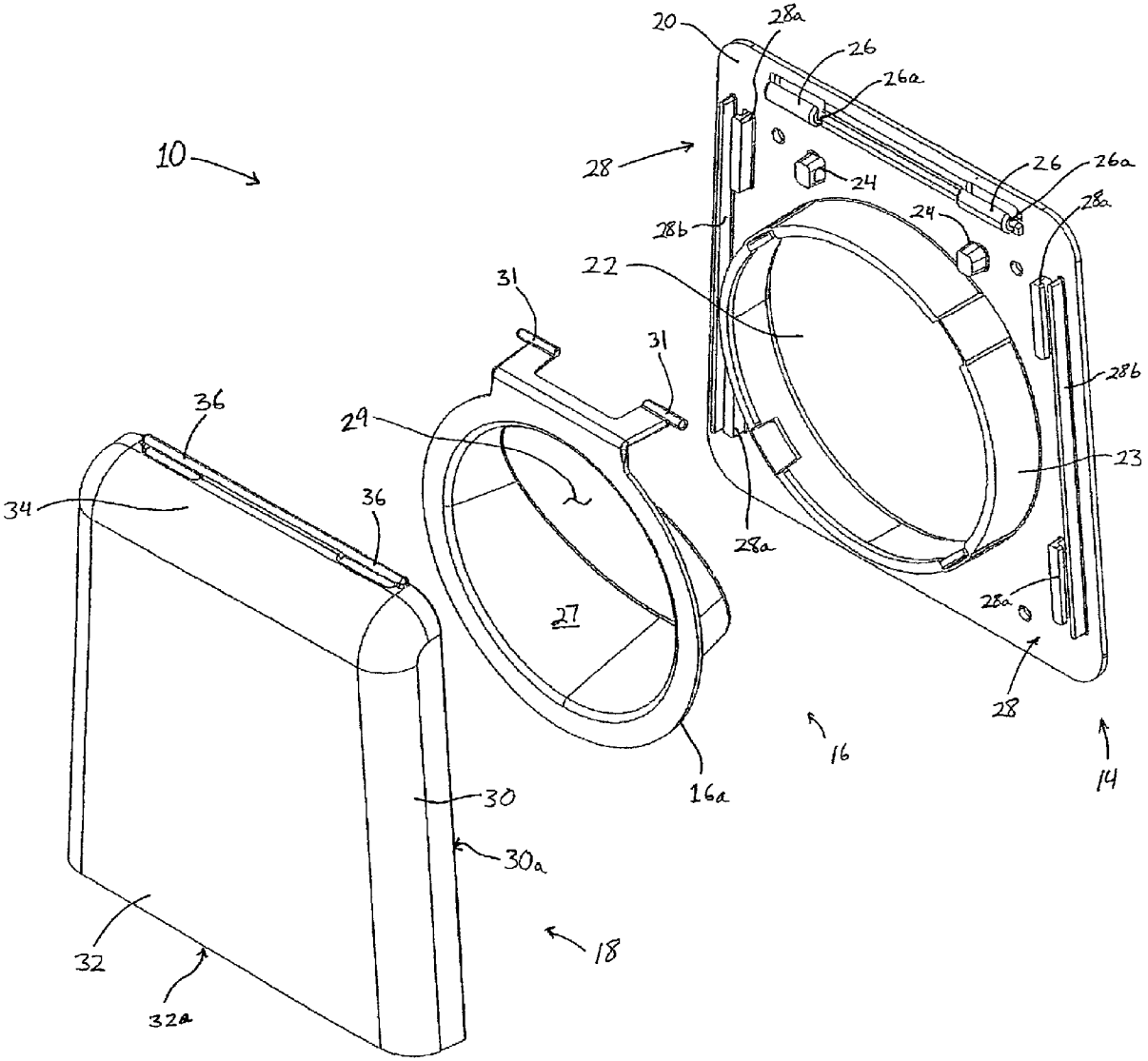
FIG. 2 is an exploded perspective view of the vent assembly of FIG. 1.

As best seen in FIG. 2, mount 14 is a plate-like structure and includes a generally planar back plate 20 having an opening 22 for receiving discharge conduit 12. Opening 22 is surrounded by a rim 23 that protrudes or extends from planar back plate 20. A pair of door supports 24 are positioned above opening 22 for pivotally supporting door 16, which is positioned in opening 22. Additionally, a pair of resilient hood supports 26 is provided adjacent door supports 24 for pivotally supporting hood 18, as will be described in greater detail below. Door 16 includes a lip 16*a* that lies adjacent or in contact with rim 23 when air is not flowing through conduit 12 (FIG. 4A). Door 16, opening 22, and the operation of door 16 in opening 22 are more fully described in U.S. patent application Ser. No. 11/477,845, filed Jun. 29, 2006, which is hereby incorporated herein by reference in its entirety.

Door 16 preferably has a truncated conical wall 27 joined to lip 16*a* and a planar plate or wall 29 joined to wall 27 to form a closure for conduit 12 when door 16 is in its closed position. A pair of hinge members 31, located at an upper portion of door 16, are pivotally received in respective door supports 24. The center of gravity of door 16 urges the door to hang substantially vertically with the plane of lip 16*a* substantially vertical and door 16 closed substantially flush onto the edge of rim 23 when mount 14 is positioned on conduit 12. Conical wall 27 serves to deter birds and small animals from accessing conduit 12 by blocking access to opening 22 when door 16 is initially moved away from its closed position adjacent rim 23 until door 16 has pivoted at least about 25 degrees outward from its closed position.

A set of guide flanges 28 is provided on either side of opening 22 for receiving side portions 30 of hood 18. Guide flanges 28 comprise inner flanges 28*a* and outer flanges 28*b*. Outer guide flanges 28*b* extend a majority of the entire length of side portions 30 and protect side portions 30 from lifting forces caused by wind or animals, for example. In addition to side portions 30, hood 18 includes lower portion 32, upper portion 34, side edges 30*a*, a lower edge 32*a*, and an upper edge 34*a*.

Figure 5:
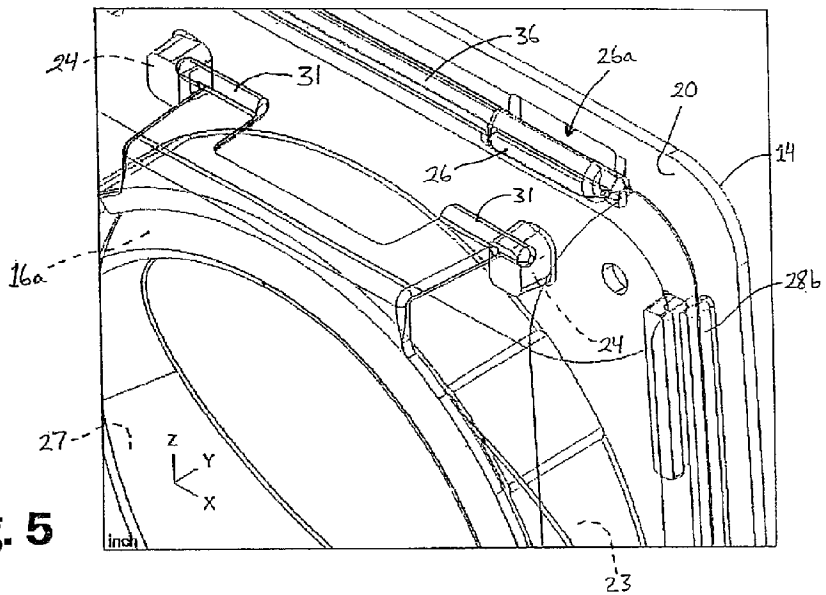
FIG. 5 is an enlarged perspective view of an upper portion of the vent assembly of FIG. 1, with the hood shown in phantom.

Hood 18 includes a pair of hinge members 36 that are substantially cylindrical and sized for pivotable engagement with grooves 26*a* in hood supports 26 (FIGS. 2 and 5). Grooves 26*a* are a pair of partially-cylindrical channels that are coaxially aligned with one another and configured to pivotally receive hinge member 36. Hood supports 26 are molded projections that are resilient so that supports 26 will flex to enlarge grooves 26*a* as hinge member 36 is snap-fit into them. Hinge member 36 is snap-fit into grooves 26*a* such that hinge member 36 is pivotably and releasably received at planar back plate 20 of mount 14 above door 16 and opening 22. The resiliency and flexibility of the material of vent assembly 10, such as molded polypropylene, facilitates the snap-fit action.

Figure 3:
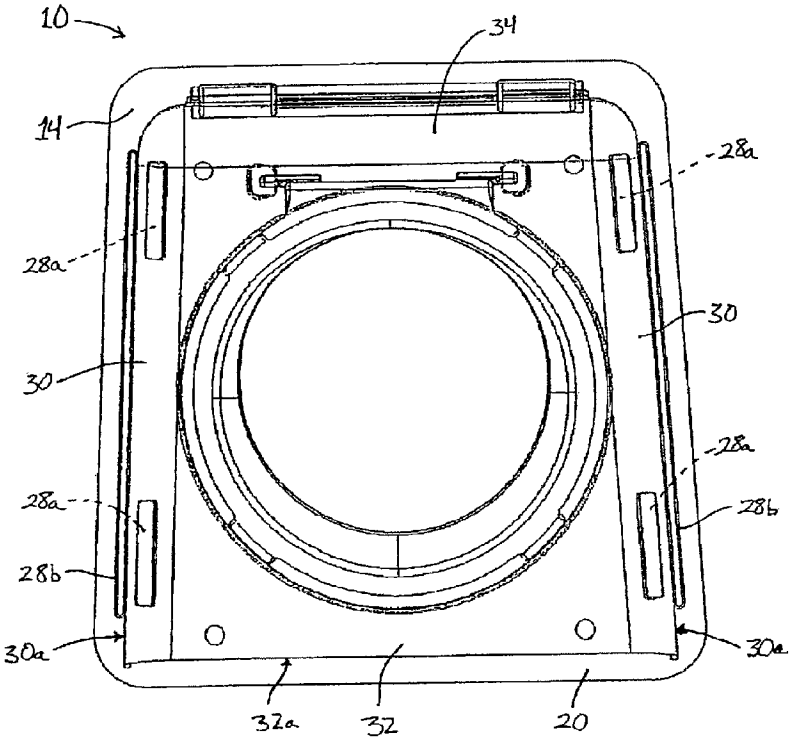
FIG. 3 is a front elevation of the vent assembly of FIG. 1 with the hood shown in phantom.

Hood 18 is movable between a closed position (FIGS. 1-4A and 5) in which side edges 30*a* are adjacent or in direct contact with back plate 20 between inner flanges 28*a* and outer flanges 28*b*, and an open position (FIG. 4B) in which hood 18 is moved away from back plate 20 of mount 14. As best seen in FIGS. 3 and 4A, when hood 18 is in the closed position lower edge 32*a* is positioned below rim 23 and lip 16*a* such that hood 18 completely covers door 16, which completely covers opening 22. Further, in the closed position, hood 18 stands out from planar back plate 20 approximately the same or a slightly greater distance than rim 23 and lip 16*a* stand out from planar back plate 20 when lip 16*a* is adjacent or contacting rim 23. In this manner, hood 18 provides a low-profile cover that serves to hold door 16 closed and discourages access to door 16 and conduit 12 by birds or small animals when door 16 and hood 18 are in their respective closed positions, while also substantially preventing access, by nest-building insects, for example, to an inner region or space defined between hood 18 and back plate 20.

Door 16 is urged into the open position by air flow indicated by arrows in FIG. 4B, as is more fully described in U.S. patent application Ser. No. 11/477,845, incorporated by reference hereinabove. Hood 18 is urged into the open position by lip 16*a* of door 16 pushing against hood 18 (FIG. 4B) and/or by air flow directed against hood to pivot hood 18 upwardly. Hood 18 is preferably made of a lightweight material, such as polypropylene or the like, so that the weight of hood 18 does not substantially urge door 16 downwardly from the door's natural or free-floating open position and unnecessarily restrict air flow through conduit 12. As best seen in FIG. 4A, when the flow of air ceases, gravity acting upon door 16 and hood 18 urges them downwardly into their respective closed positions.

Accordingly, the vent assembly 10 provides an animal- and wind-resistant cover for fluid conduit 12 where the conduit exits a building, without substantially hindering the flow of air through the conduit when an associated clothes dryer or fan is operating. Further, the close proximity or contact of hood 18 and door 16 when they are in their open positions substantially prevents the flow of air that is laden with lint or dirt between hood 18 and door 16, which substantially prevents the buildup of lint or dirt between hood 18 and mount 14, between door 16 and mount 14, and in the vicinity of door supports 24 and hood supports 26. The prevention of buildup of lint or dirt in these areas facilitates the continued proper operation of vent assembly 10 without need for frequent visual inspections or manual cleanout of the assembly. Additionally, hood 18 helps to prevent flapping or movement of door 16 in windy conditions when no air is flowing through conduit 12.

Optionally, and with reference to FIGS. 6-11, an alternative vent assembly 110 for connection to a fluid discharge conduit 112 includes a mounting member or mount 114, a door 116, and a hood 118. When closed, hood 118 completely covers or encloses a rim 123 that protrudes or extends from a planar back plate 120 of mount 114. Hood 118 includes an upper portion 134 that is contoured away from hinge members 136 such that an upper shoulder edge 134*a* is spaced from back plate 120 when hood 118 is open, as will be described in greater detail below. Hinge members 136 comprise cylindrical horizontal projections that extend laterally outwardly from upper portion 134. Hinge members 136 are pivotably received in corresponding hood supports 126 of mount 114.

In the illustrated embodiment, a backing plate 135 is spaced from mount 114 on conduit 112 such that a building wall (not shown) is received between backing plate 135 and mount 114. Backing plate 135 improves the aesthetic appearance of the interior wall surface where conduit 112 passes through the wall, and may provide an additional weather seal or prevent or reduce air leaks, drafts or the like. Vent assembly 110 is substantially similar to vent assembly 10, with corresponding components identified with like numerals having 100 added thereto, such that a detailed discussion of each of the components of vent assembly 110 need not be repeated herein.

Figure 10B:
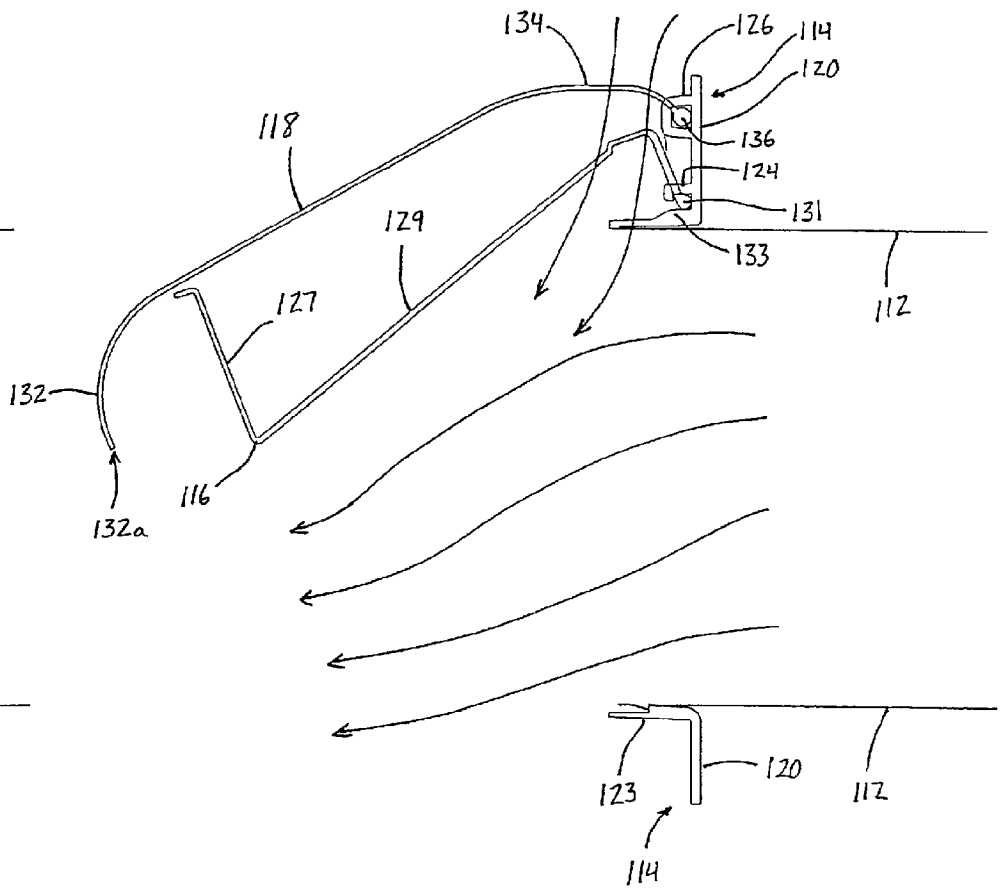
FIG. 10B is a side sectional view of the vent assembly in an open position when air is flowing through the conduit.
Figure 10A:
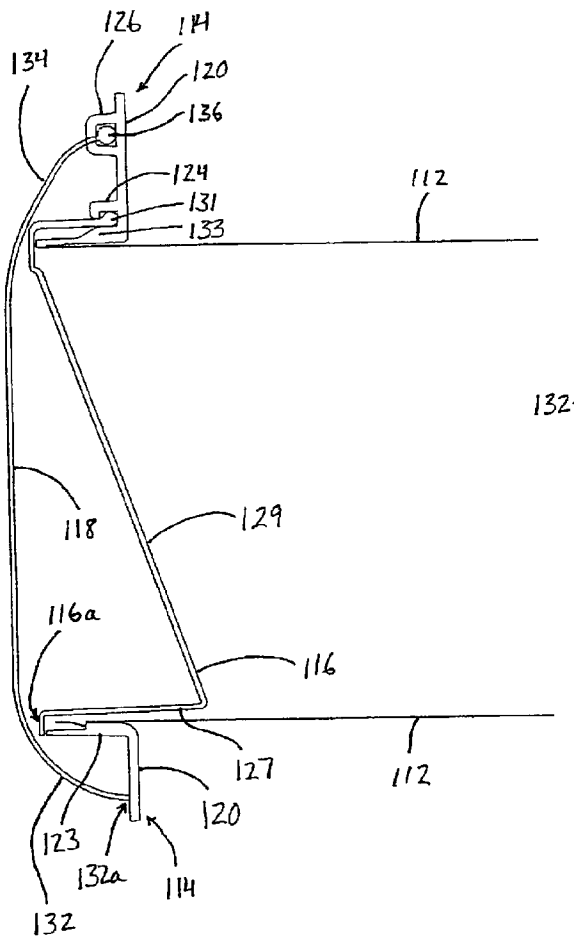
FIG. 10A is a side sectional view of the vent assembly in a closed position.
Figure 11:
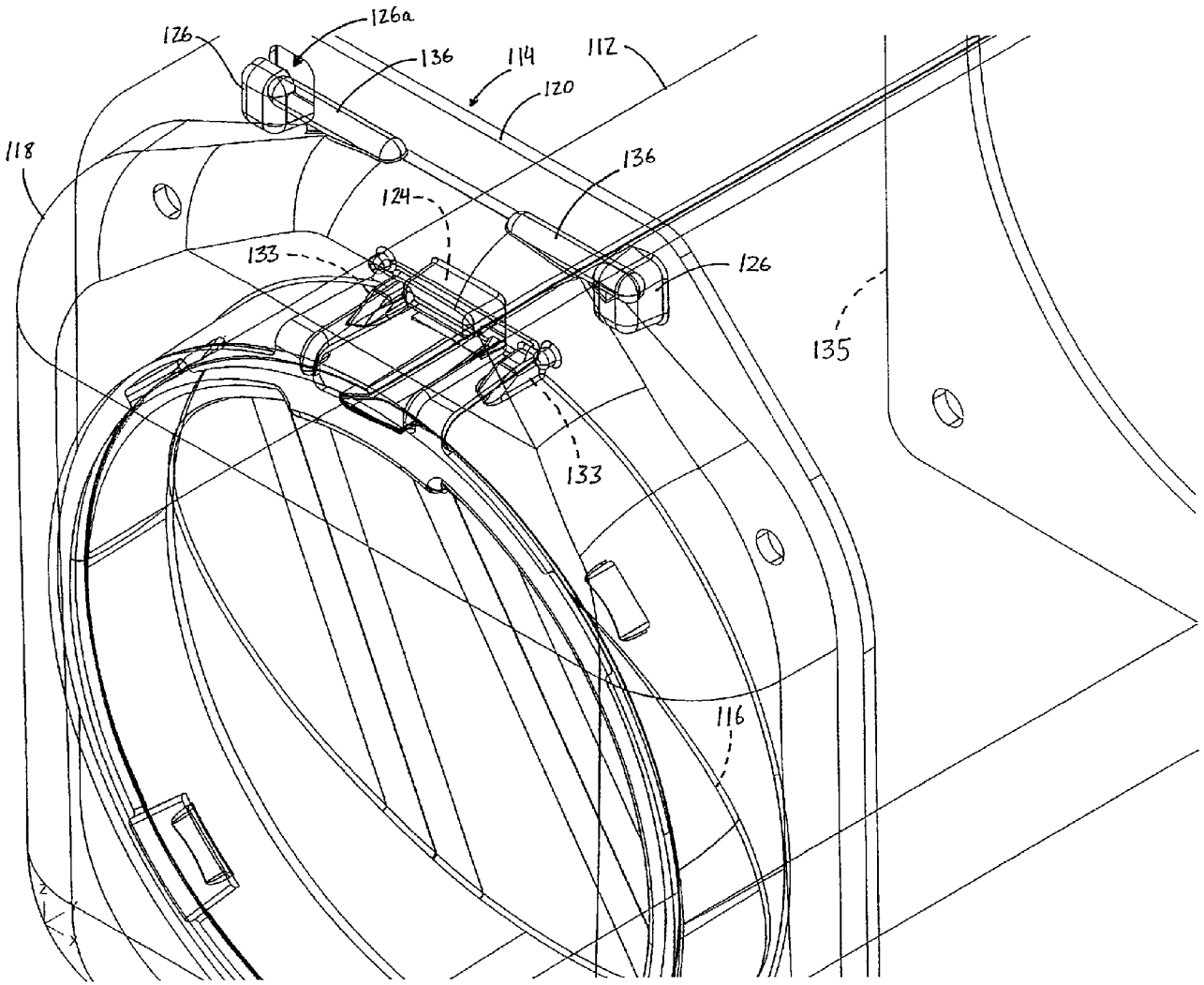
FIG. 11 is an enlarged perspective view of an upper portion of the vent assembly of FIG. 6, with the hood shown in phantom.

Door 116 includes a single hinge member 131 that is received between a door support 124 and a pair of spaced protrusions or flanges 133 that extend outwardly from rim 123 (FIGS. 10A-11). Hinge member 131 is a cylindrical pin that snaps between door support 124 (which includes a downward projection to releasably capture hinge member 131) and flanges 133, which are located somewhat below door support 124. Door support 124 permits door 116 to pivot outwardly away from rim 123, such as when air is discharged through conduit 112 and out through an opening 122 in back plate 120.

Figure 7:
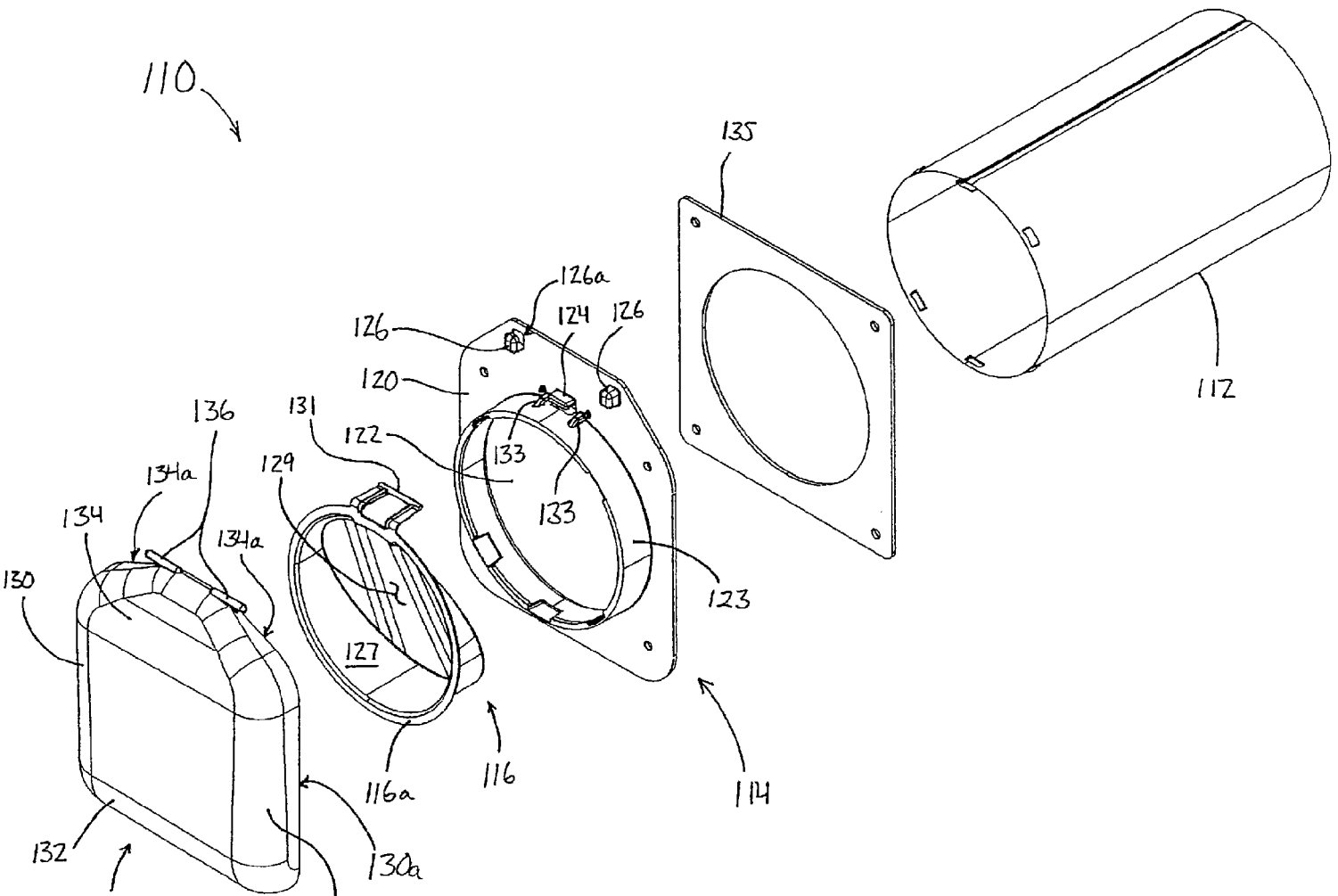
FIG. 7 is an exploded perspective view of the vent assembly of FIG. 6.
Figure 8:
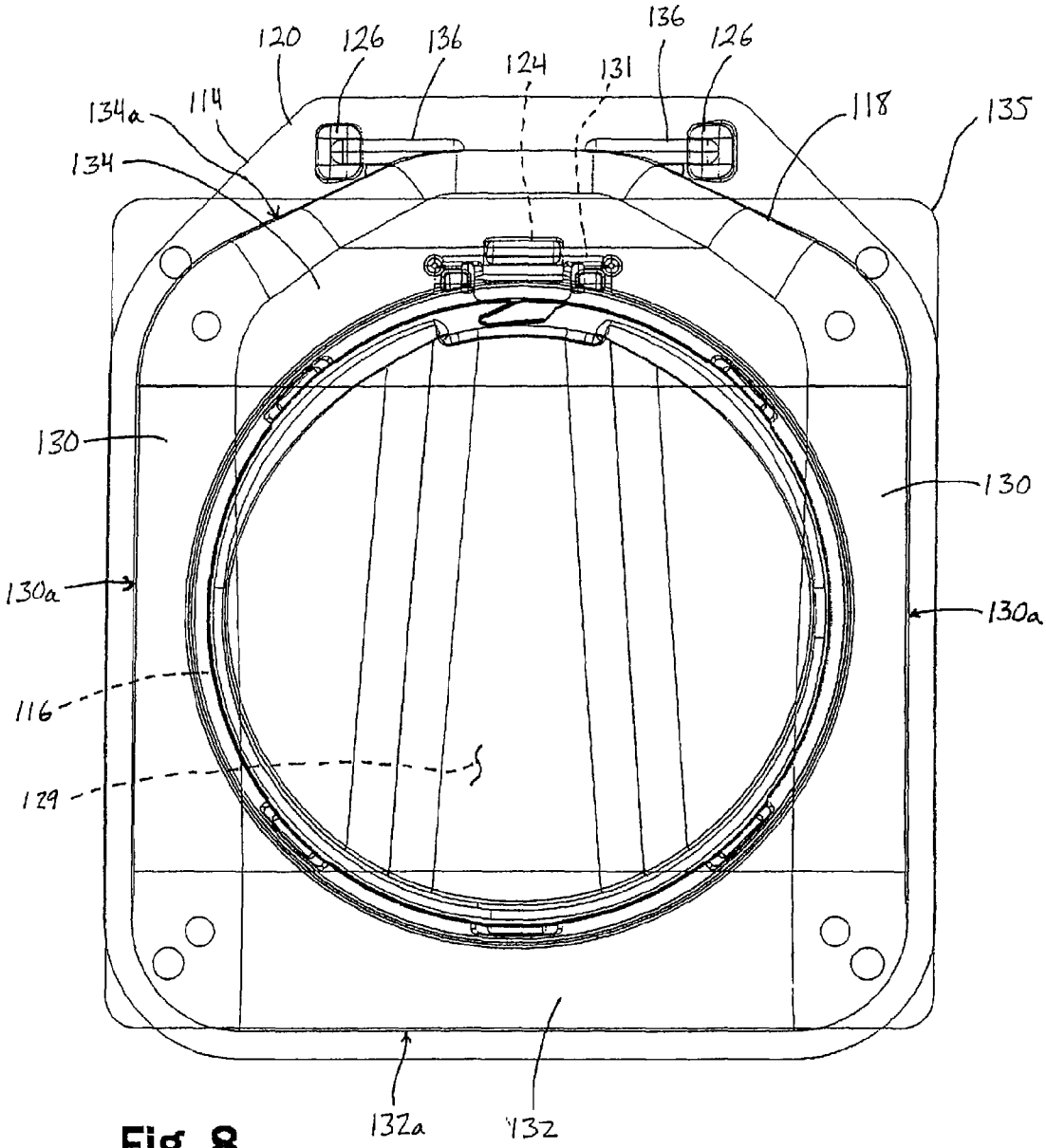
FIG. 8 is a front elevation of the vent assembly of FIG. 6 with the hood shown in phantom.
Figure 9:
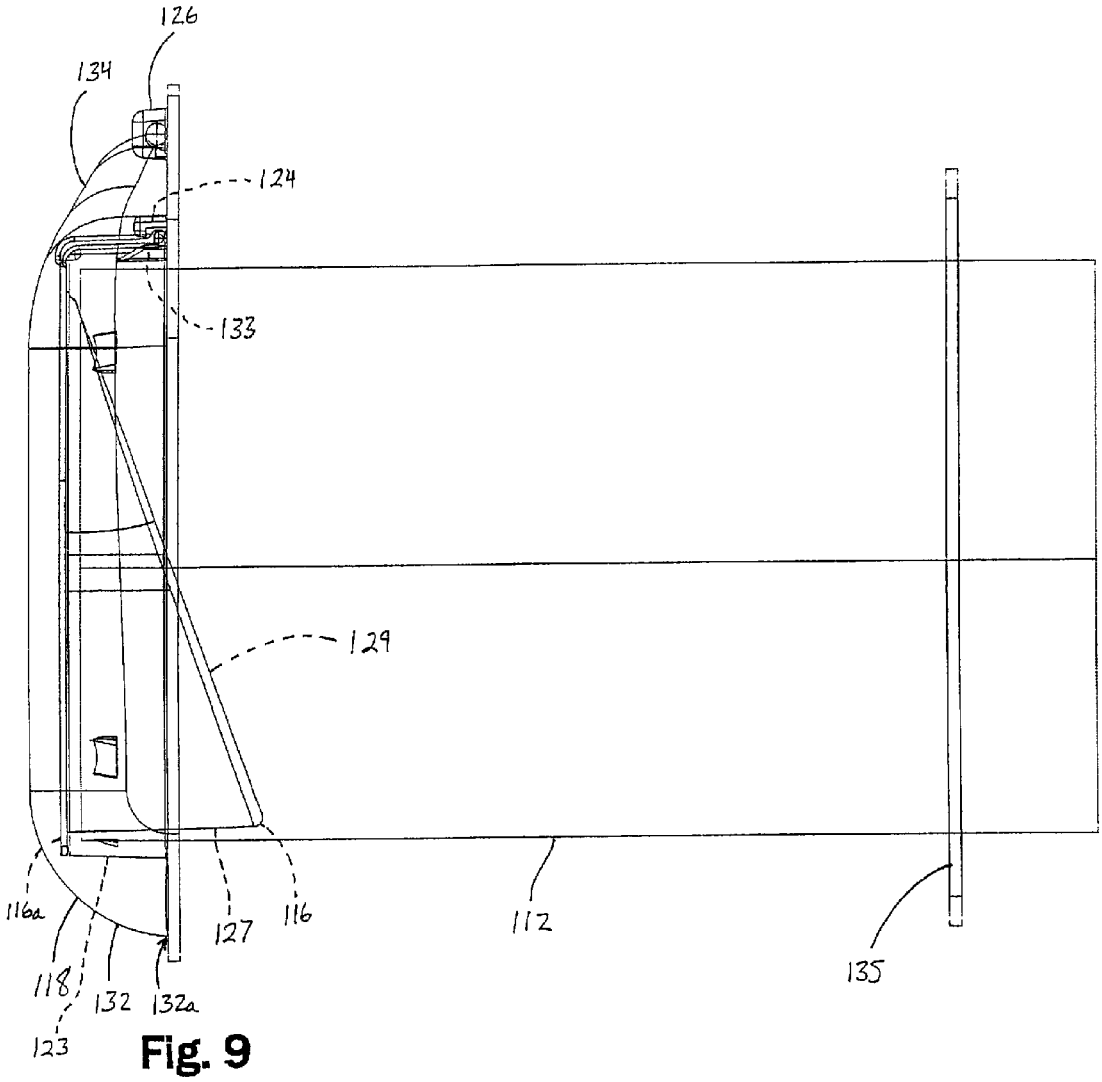
FIG. 9 is a side elevation of the vent assembly of FIG. 6 in a closed position.

Hood 118 includes a lower portion 132 that terminates at a lower edge 132*a* that abuts back plate 120 when hood 118 is closed. Lower edge 132*a* joins and is substantially coplanar with side edges 130*a*, which join and are substantially coplanar with upper shoulder edge 134*a* (FIGS. 7 and 9). Thus, edges 132*a*, 130*a*, 134*a* cooperate to substantially prevent access or fluid circulation around rim 123 and door 116 when fluid is not being discharged from conduit 112 and hood 118 is closed (FIG. 10A).

Figure 12:
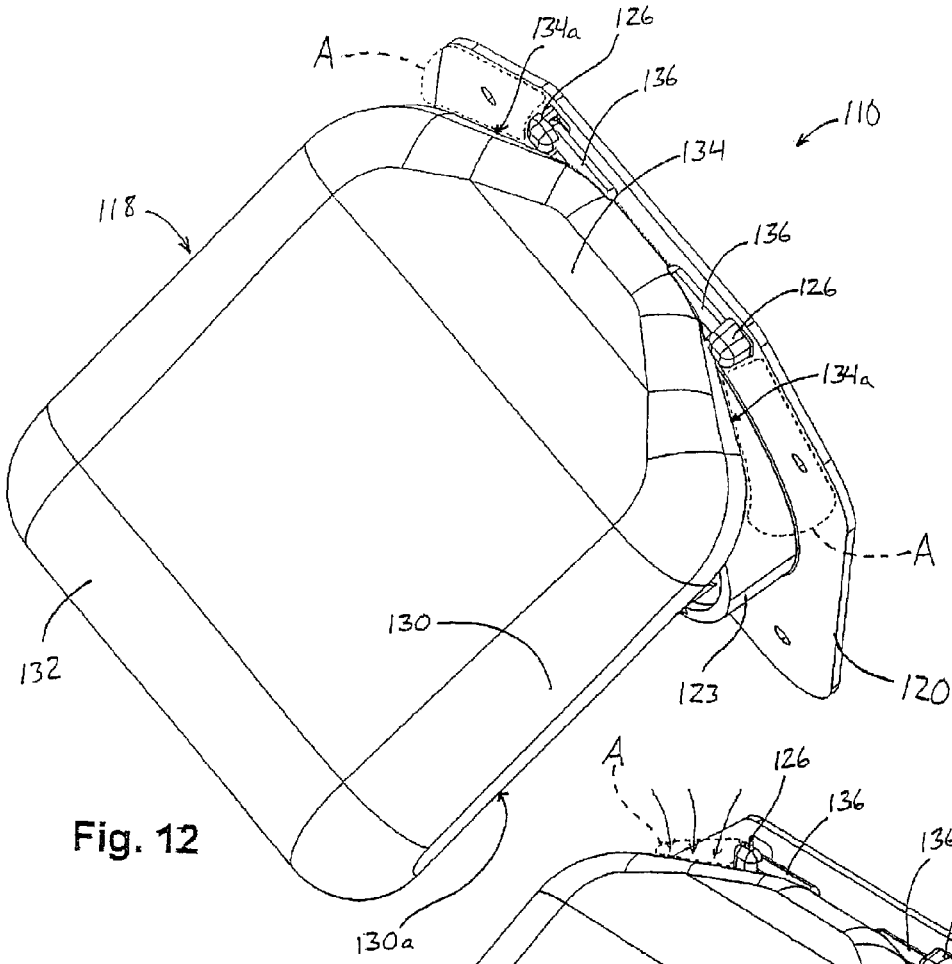
FIG. 12 is a perspective view of the vent assembly of FIG. 10B, taken primarily from above.
Figure 13:
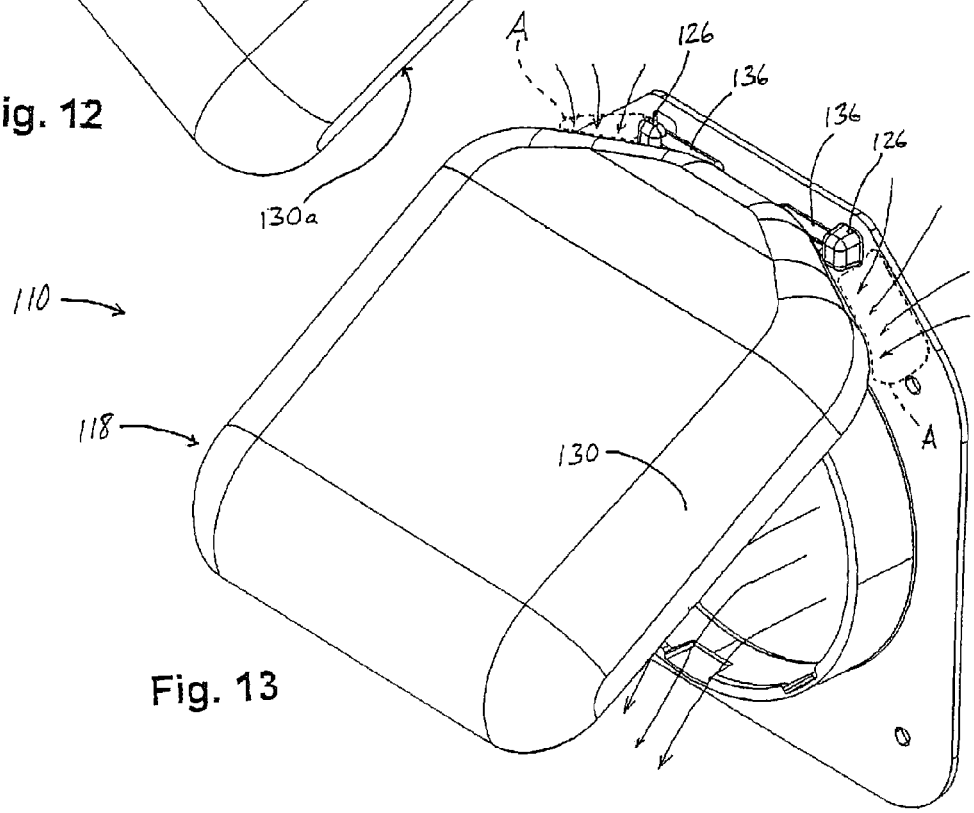
FIG. 13 is a perspective view of the vent assembly of FIG. 10B, taken from above and from the side.

As best seen in FIGS. 12, and 13, when hood 118 is raised by the discharge of fluid from conduit 112, fluid flow paths or open areas A are formed generally between back plate 120 and upper shoulder edges 134*a* of hood 118. Open areas A provide a fluid flow path for ambient fluid, such as air, to be drawn into the fluid flow path of the fluid (such as hot laundry dryer air) that is being discharged from conduit 112, where the ambient fluid and discharge fluid flow paths are depicted with arrows in FIGS. 10B and 13. The discharge fluid creates a low pressure area below door 116 due to the fluid flow (such as according to Bernoulli's principle), which draws higher pressure ambient fluid down through open areas A. The ambient fluid drawn into the discharge fluid path forms a cushion or layer of relatively clean ambient fluid between door 116 and the discharge fluid, which may be somewhat laden or contaminated with lint or other debris.

Thus, the flow of ambient fluid drawn through areas A and between door 116 and the discharge fluid, limits or substantially prevents the buildup of lint, dirt, or debris carried by the discharge fluid through vent assembly 110. Accordingly, vent assembly 110 permits substantially unrestricted flow of discharge fluid through conduit 112, while preventing or limiting lint or debris from collecting along surfaces of door 116 and hood 118 and preventing access to the conduit by birds or small animals.

Changes and modifications in the specifically described embodiments may be carried out without departing from the principles of the present invention, which is intended to be limited only by the scope of the appended claims, as interpreted according to the principles of patent law including the doctrine of equivalents.

We claim:

1. A vent assembly for attachment to a fluid discharge conduit, said vent assembly comprising:

a mount having an opening, said opening adapted to receive the conduit;

a door pivotally received by said mount for covering said opening; and a hood pivotally received by said mount for covering said opening and said door;

wherein said door is pivotable such that it is displaced from a closed position to an open position fluid by flowing through the discharge conduit and engaging said door, and wherein said hood is pivotable with respect to said mount and said door, wherein said hood is initially displaced toward said open position by said door, whereby birds, animals, and the like are restricted from entering the conduit.

2. The vent assembly of claim 1 wherein said hood is urged into said open position only after said door pivots sufficiently to contact said hood.

3. The vent assembly of claim 2 wherein said door supports said hood in said open position of said hood when said door is engaged by fluid flowing through the discharge conduit.

4. The vent assembly of claim 1 wherein said hood is urged into said open position at least partially via engagement of said hood by fluid flowing through the discharge conduit.

5. The vent assembly of claim 1 wherein said door does not contact said hood when said door and said hood are in their respective open positions.

6. The vent assembly of claim 1 wherein said hood is pivotally snap-mounted on said mount.

7. The vent assembly of claim 1 wherein said mount, said door, and said hood each comprise polymeric material.

8. The vent assembly of claim 1, wherein said door comprises a first surface portion for covering at least a portion of said opening and a second surface portion joined to said first surface portion, wherein said first and second surface portions extend into said opening, said door being in said open position only after said door pivots sufficiently to move said first and second surface portions fully out of said opening.

9. The vent assembly of claim 8 wherein said first and second surface portions form a wedge-like shape, said first surface portion including a planar plate, said second surface portion including a conical wall forming a base of said wedge-like shape, said base being located opposite the position at which said door is pivotally received by said mount.

10. The vent assembly of claim 8 wherein said first and second surface portions form a recessed cavity in said door.

11. The vent assembly of claim 10 wherein said recessed cavity opens outwardly of said opening.

12. The vent assembly of claim 9 wherein said door further includes a lip extending from said second surface portion of said door, said lip engaging said mount in said closed position.

13. The vent assembly of claim 12 wherein said mount includes a rim surface protruding from said mount to receive the conduit, said rim surface receiving and engaging said lip in said closed position.

14. The vent assembly of claim 13 wherein said lip rests substantially flush on said rim surface and said first and second surface portions extend into said opening when said door is in said closed position.

15. A venting system comprising:

a discharge conduit connectable to an air exhaust outlet, said discharge conduit having an open end;

a mount having an opening, said opening received by said discharge conduit;

a hood pivotally received by said mount for covering said opening and said door; and a door pivotally received by said mount for covering said opening;

wherein said door is pivotable such that it is displaced from a closed position to an open position by fluid flowing through said discharge conduit and engaging said door, and wherein said hood is pivotable with respect to said mount and said door, wherein said hood is initially displaced toward said open position by said door, whereby birds, animals, and the like are restricted from entering the conduit.

16. The venting system of claim 15, wherein said hood is urged into said open position only after said door pivots sufficiently to contact said hood.

17. The venting system of claim 15, wherein said hood is urged into said open position when said hood is engaged by fluid flowing through the discharge conduit.

18. The venting system of claim 15, wherein said door comprises a first surface portion for covering at least a portion of said opening and a second surface portion joined to said first surface portion, wherein said first and second surface portions extend into said opening, said door being in said open position only after said door pivots sufficiently to move said first and second surface portions fully out of said opening.

19. The venting system of claim 18, wherein said first and second surface portions form a wedge-like shape, said first surface portion including a planar plate, said second surface portion including a conical wall forming the base of said wedge like shape, said base of said wedge-like shape being located opposite the position at which said door is pivotally received by said mount.

20. A vent assembly for attachment to a fluid discharge conduit, said vent assembly comprising:

a mount having an opening, said opening adapted to receive the conduit;

a door pivotally received by said mount for covering said opening;

a hood pivotally received by said mount for covering said opening and said door, said hood comprising a substantially continuous edge that contacts said mount and surrounds said opening and said door when said hood is in a closed position;

a hinge member at an upper portion of said hood, said hinge member adapted to pivotally engage said mount; and wherein said door is operable for displacement with respect to said opening form a closed position to an open position by a discharge fluid flowing through the discharge conduit and engaging said door, and wherein said hood is operable for displacement with respect to said mount, said hood is initially displaced toward said open position by said door, whereby birds, animals, and the like are restricted from entering the conduit.

21. The vent assembly of claim 20, wherein at least a section of said upper portion of said hood extends downwardly away from said hinge member when said hood is in said closed position to at least partially define a fluid path between said upper portion of said door and said mount when said hood is in said open position.

22. The vent assembly of claim 21, wherein said fluid path permits an ambient fluid to be drawn from an area above said upper portion of said hood to an area below said hood and said door when said hood and said door are open in response to the discharge fluid flowing through the conduit.

23. The vent assembly of claim 20, wherein said door supports said hood in an open position when said door is engaged by the discharge fluid flowing through the conduit.

24. The vent assembly of claim 20, wherein said door comprises a first surface portion for covering at least a portion of said opening and a second surface portion joined to said first surface portion, wherein said first and second surface portions extend into said opening, said door being in said open position only after said door pivots sufficiently to move said first and second surface portions fully out of said opening.

25. The vent assembly of claim 20 wherein said mount, said door, and said hood each comprise polymeric material.

* * * * *

UNITED STATES PATENT AND TRADEMARK OFFICE

CERTIFICATE OF CORRECTION

PATENT NO. : 8,033,900 B2
APPLICATION NO. : 12/201616
DATED : October 11, 2011
INVENTOR(S) : Kalvin K. Vanden Bosch It is certified that error appears in the above-identified patent and that said Letters Patent is hereby corrected as shown below:

In the Claims

Column 7
Line 45, Claim 1, “fluid by flowing” should be --by fluid flowing--

Column 8
Line 44, Claim 15, “wherein” should be --and--

Column 9
Line 15, Claim 20, “form” should be --from--

Signed and Sealed this
Thirteenth Day of May, 2014

Michelle K. Lee

Michelle K. Lee
*Deputy Director of the United States Patent and Trademark Office*